United States Patent [19]

Deutsch

[11] 3,951,030

[45] Apr. 20, 1976

[54] IMPLEMENTATION OF DELAYED VIBRATO IN A COMPUTOR ORGAN

[75] Inventor: Ralph Deutsch, Sherman Oaks, Calif.

[73] Assignee: Nippon Gakki Seizo Kabushiki Kaisha, Japan

[22] Filed: Sept. 26, 1974

[21] Appl. No.: 509,704

[52] U.S. Cl. ..... 84/1.25; 235/152; 235/197

[51] Int. Cl.[2] ..... G10H 1/04; G10H 5/00

[58] Field of Search ..... 84/1.01, 1.24, 1.25, 84/DIG. 4, DIG. 5, DIG. 26; 179/1 J; 235/152, 197

[56] References Cited

UNITED STATES PATENTS

| | | | |
|---|---|---|---|
| 3,515,792 | 6/1970 | Deutsch | 84/1.24 X |
| 3,681,531 | 8/1972 | Burkhard et al. | 179/1 J |
| 3,749,837 | 7/1973 | Doughty | 179/1 J |
| 3,757,022 | 9/1973 | Markowitz | 84/1.25 |
| 3,809,786 | 5/1974 | Deutsch | 84/1.01 |
| 3,809,788 | 5/1974 | Deutsch | 84/1.01 |
| 3,809,789 | 5/1974 | Deutsch | 84/1.01 |
| 3,809,790 | 5/1974 | Deutsch | 84/1.01 |
| 3,816,637 | 6/1974 | Whitefield | 84/1.24 |
| 3,831,015 | 8/1974 | Hoff, Jr. | 235/197 |
| 3,882,751 | 5/1975 | Tomisawa et al. | 84/1.01 |

*Primary Examiner*—L. T. Hix
*Assistant Examiner*—Stanley J. Witkowski
*Attorney, Agent, or Firm*—Howard A. Silber

[57] ABSTRACT

Delayed vibrato is implemented in an electronic musical instrument of the type wherein the fundamental frequency of the generated tone is proportional to a frequency number R supplied to the instrument. At the beginning of note production, the frequency number R itself is supplied to the instrument for a preselected delay time, so that no vibrato is introduced during this initial delay time. Subsequently a periodically varying fractional frequency number $R_v$ is added to the frequency number R and the sum supplied to the instrument. This causes the generated tone to exhibit vibrato at a rate corresponding to the periodicity of the value $R_v$. The depth of vibrato is established by the maximum value of $R_v$ and may be varied by scaling $R_v$. Advantageously such scaling is done when the vibrato begins, so that the vibrato depth will increase gradually to the maximum value.

9 Claims, 3 Drawing Figures

IMPLEMENTATION OF DELAYED VIBRATO IN A COMPUTOR ORGAN

BACKGROUND OF THE INVENTION

1. Field of the Invention

The present invention relates to production of delay vibrato in a computor organ of the type disclosed in U.S. Pat. No. 3,809,786.

2. Description of the Prior Art

Vibrato is a frequency modulation of a musical tone, typically at a rate of from about 5Hz to 8Hz. When playing some instruments, notably the violin, the musician will not always introduce vibrato. Thus when playing fast, no vibrato is used. However, when a long sustained note is played, the violinist first sounds the note without vibrato, then gradually adds the vibrato by vibrating his finger on the string. This gradual introduction is called "delayed vibrato" or "string vibrato", and it is a principal object of the present invention to implement such delayed vibrato in an electronic musical instrument.

In the inventor's COMPUTOR ORGAN disclosed in the above mentioned U.S. Pat. No. 3,809,786 musical tones are generated by computing in real time the amplitudes at successive sample points of a complex musical waveshape, and converting these amplitudes to musical sounds. Such computations are carried out each time that a keyboard key is depressed. The fundamental frequency of the generated tone is proportional to a frequency number R that is selected by the depressed key. The manner in which the computations are carried out to generate the musical tones is completely set forth in the cited U.S. Pat. No. 3,809,786 which is incorporated herein by reference. The instrument disclosed in that patent herein is called the "patented computor organ" or simply the "computor organ."

Another object of the present invention is to implement delayed vibrato in such a computor organ. Thus, using the circuitry disclosed herein, whenever a key is depressed the selected note first will be generated without vibrato. If the key is kept depressed for longer than a selectable delay period $T_D$, vibrato will start to be introduced. The depth of vibrato will increase gradually, until at a time $T_V$ the full vibrato depth will be reached. Thereafter vibrato will continue until note production ceases after the key has been released. This effect is illustrated in FIG. 1.

Typically the vibrato modulation waveshape is a sinusoid, but this is not necessary, and another object of the present invention is to implement vibrato of selectable modulation waveshape. A further object is to permit control of the depth of vibrato, i.e., of the frequency excursion of the vibrato modulation away from the nominal fundamental frequency of the generated tone.

SUMMARY OF THE INVENTION

These and other objects are achieved in a computor organ by modifying in a time dependent manner the value of the frequency number R utilized in the waveshape computations. Referring to FIG. 1, when a key is depressed at time $T_o$, the selected value R is supplied to the tone generating components of the patented computor organ. A vibrato-free tone is produced at the nominal fundamental frequency established by the supplied value R.

After a controllable time $T_D$ the value of the frequency number supplied to the computor organ begins to be modified as a function of time. Specifically, a time varying factor $\pm R_V$ is added to the selected frequency number R to obtain a vibrato modulated frequency number R'. This value:

$$R' = R \pm R_v \qquad \text{(Equation 1)}$$

then is supplied to the computor organ in place of R. The rate at which $R_V$ is varied will determine the vibrato rate, and the magnitude of $R_V$ will establish the depth of vibrato.

In certain embodiments, the value $R_V$ advantageously is a fraction of the selected frequency number R, so that:

$$R_V = kR \qquad \text{(Equation 2)}$$

where $k$ is a constant which itself may be time variant. In a digital implementation, $k$ may be a fractional power of 2 such as:

$$k = 2^{-n} \qquad \text{(Equation 3)}$$

in which case:

$$R_V = \frac{R}{2^n} \qquad \text{(Equation 4)}$$

where $n$ is an integer. Observe that equation 4 corresponds to right shifting a binary value R by n positions, since a right shift of one position corresponds to division by 2. Consequently the value $R_V$ readily can be obtained using a shift register, and this technique is employed in the implementation of FIG. 2.

In the alternative embodiment of FIG. 3 the more generalized equation 2 is implemented by storing a set of values $k$ in a memory. These are accessed sequentially at a rate controlled by a vibrato rate clock. The keyboard-selected frequency number R is multiplied by the accessed value k and the product (corresponding to $R_V$) is supplied to the computor organ for use in the waveshape amplitude computations.

The depth of vibrato can be controlled by scaling the fractional frequency number $R_V$ by a scale factor s. Advantageously the value of s is zero between times $T_o$ and $T_D$ and gradually increases from zero to one during the time interval from $T_D$ to $T_V$ (see FIG. 1). In this manner, there is no vibrato until time $T_D$ and thereafter the depth of vibrato gradually is increased until maximum depth is reached at time $T_V$.

BRIEF DESCRIPTION OF THE DRAWINGS

A detailed description of the invention will be made with reference to the accompanying drawings wherein like numerals designate corresponding elements in the several figures.

DESCRIPTION OF THE PREFERRED EMBODIMENTS

The following detailed description is of the best presently contemplated modes of carrying out the invention. This description is not to be taken in a limiting sense, but is made merely for the purpose of illustrating the general principles of the invention since the scope of the invention best is defined by the appended claims.

Operational characteristics attributed to forms of the invention first described also shall be attributed to forms later described, unless such characteristics obviously are inapplicable or unless specific exception is made.

Figure 1:
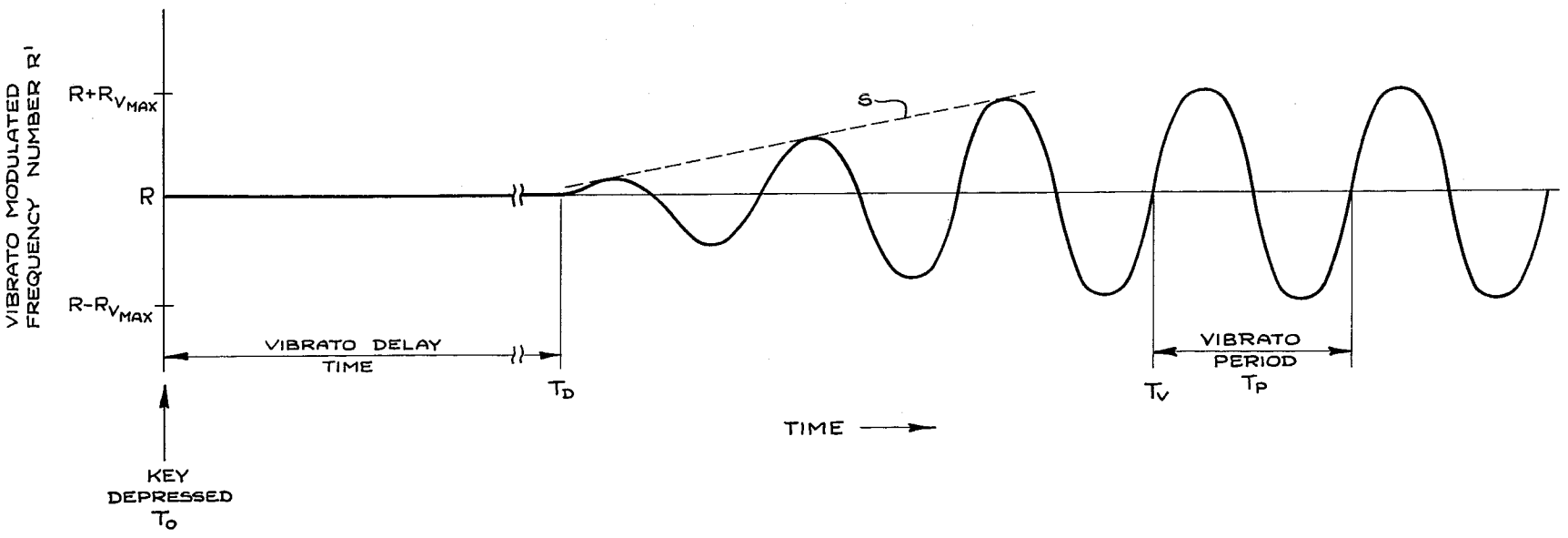
FIG. 1 is a graph of the vibrato modulated frequency number R' as a function of time during production of delayed vibrato.
Figure 2:
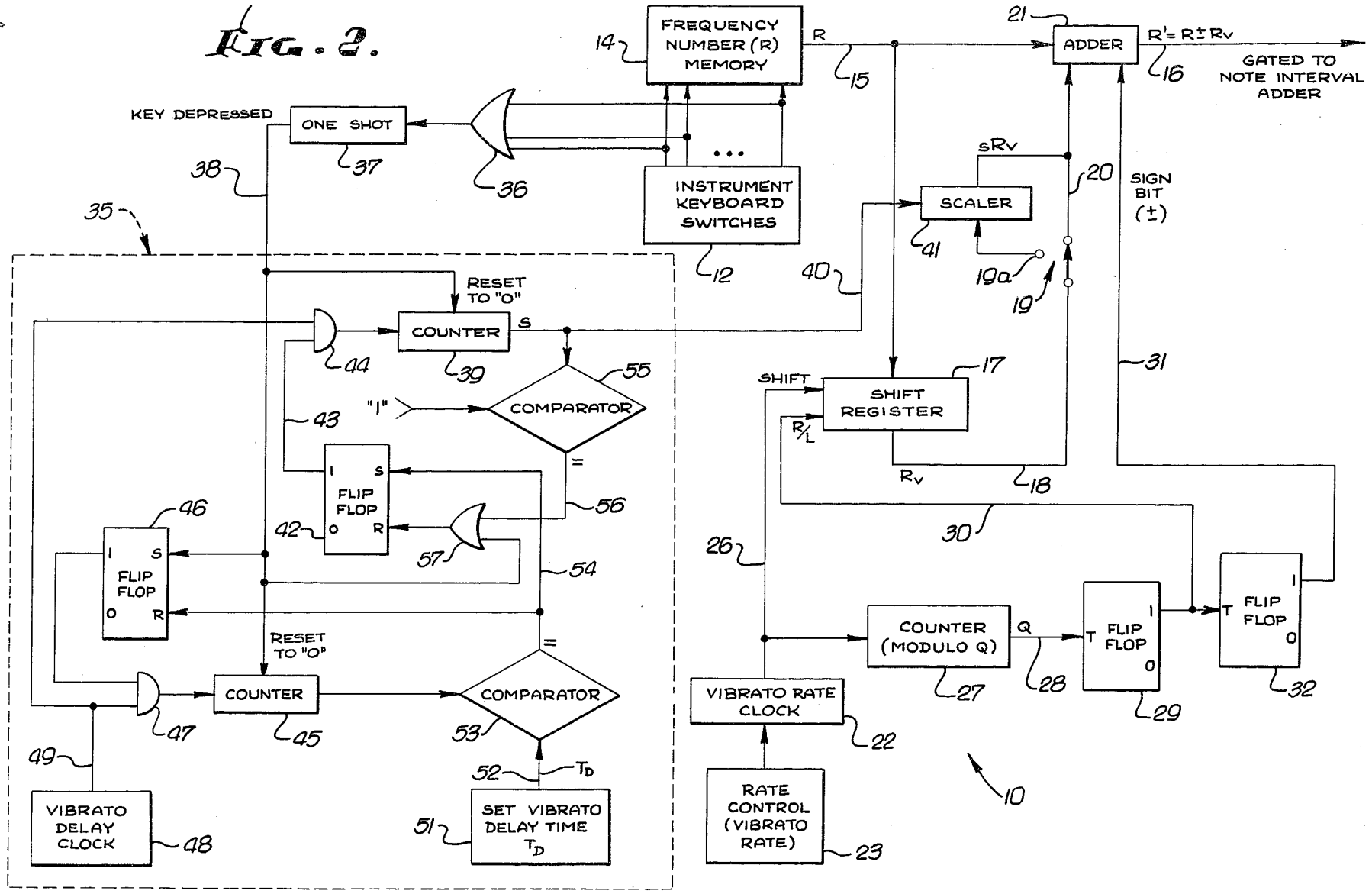
FIG. 2 is an electrical block diagram of circuitry for implementing delayed vibrato in a computor organ, and utilizing a shift register to obtain the time varying fractional frequency number $R_v$.

The delayed vibrato circuitry 10 of FIG. 2 advantageously operates in conjunction with the computor organ of U.S. Pat. No. 3,809,786. The instrument includes keyboard switches 12 and an associated frequency number memory 14. When any key 12 is depressed, the memory 14 supplies on a line 15 the frequency number R corresponding to the nominal fundamental frequency of the selected note. In the computor organ, this value R is used to compute the sample point amplitudes of a musical waveshape. In accordance with the present invention however, the vibrato modulated frequency number R′ of equation 1, or the scaled value sR′ is used instead of the frequency number R in the waveshape amplitude computations. To this end, the value R′ or sR′ is supplied via a line 16 to the computor organ. Specifically, the line 16 would provide an input to the note interval adder 25 shown in FIG. 1 of the U.S. Pat. No. 3,809,786 via the gate 24 of that figure.

The value $R_v$ is obtained in accordance with equation 4 by shifting the value R in a shift register 17. The output of the shift register 17, constituting the fractional frequency number $R_v$ is supplied via a line 18, a switch 19 and a line 20 to an adder 21 where it is summed with the value R present on the line 15. The sum is supplied to the line 16.

If a constant value $R_v$ were added to the frequency number R, the generated tone would not exhibit vibrato, but would merely be shifted in frequency by an amount proportional to $R_v$ away from the nominal fundamental frequency. To accomplish vibrato frequency modulation, the value $R_v$ must itself be varied in time at the desired vibrato rate. This is achieved by appropriately shifting the register 17 at a rate established by a clock 22 the frequency of which is adjustable by means of a rate control circuit 23.

By way of example, the frequency number R may comprise a 16-bit binary number. If this value is shifted 16 bits to the right in the register 17, the resultant value $R_v$ will be zero. The corresponding value R′ supplied on the line 16 will be R′=R. If the value R is shifted say $n$=10 positions to the right, then $$R_v = \frac{R}{2^{10}}.$$

For ease of exposition, assume that this is the maximum value of $R_v$. Accordingly, the greatest frequency excursion will occur when $$R' = R \pm R_{v\,max} = R \pm \frac{R}{2^{10}}.$$

Output pulses from the vibrato rate clock 22 are supplied via a line 26 to both the shift input of the register 17 and to a counter 27 of modulo Q. Advantageously, Q equals the difference in value n required to obtain minimum and maximum values of $R_v$. Thus in the example where $R_{v\,min}$ occurs when n=16 and $R_{v\,max}$ is obtained for $n$=10, the value Q=16−10=6.

Each time the counter 27 reaches a count of Q an output pulse is supplied on a line 28 and the counter 27 automatically resets to zero. The pulse on the line 28 is supplied to the toggle (T) input of a flip-flop 29. As a result, the flip-flop 29 changes state each time Q pulses have been supplied from the clock 22, i.e., each time the register 17 has been shifted Q positions. The "1" output of the flip-flop 29 is supplied via a line 30 to the right-left (R/L) control input of the shift register 17. As a result, after the register 17 has gone through Q shifts in one direction (say to the right) it will then reverse direction and perform the next Q shifts in the opposite direction. As a result, the value $R_v$ provided on the line 18 will alternately increase and decrease in value between its maximum and minimum amounts.

To insure that the values $R_v$ are alternately added to and subtracted from the frequency number R during alternate half-cycles of the vibrato period, a sign bit is supplied to the adder 21 via a line 31 from the "1" output of a flip-flop 32. This flip-flop 32 is toggled by the signal on the line 30 each time that the register 17 changes shift direction. As a result, the sign bit on the line 31 will change value each time that the fractional frequency number $R_v$ has gone through a complete cycle from minimum to maximum and back again to minimum.

As a result of the foregoing operation, at the beginning of each vibrato period the minimum value $R_{v\,min}$ will be added to the frequency number R. At successive pulses from the clock 22, increasing values of $R_v$ will be added to the frequency number R. After Q such pulses occur, the shift register will reverse direction and decreasing values of $R_v$ will be added to R by the adder 21. When the minimum value $R_{v\,min}$ again is reached, the shift direction of the register 17 again will reverse and the flip-flop 32 will be toggled to provide a minus sign bit to the adder 21. As a result, the values $R_v$ now will be subtracted from R. Again $R_v$ will go through a cycle ranging from minimum to maximum and back again to minimum value as 2Q pulses are supplied from the clock 22. At the end of this cycle, the flip-flop 32 again will be toggled and the next cycle will start with values of $R_v$ added to the frequency number R.

From the foregoing description it can be seen that the vibrato frequency $f_v$ is given by:

$$f_v = \frac{1}{T_p} = \frac{f_{clock}}{4Q} \qquad \text{(Equation 5)}$$

where $T_P$ is the vibrato period (FIG. 1), where $f_{clock}$ is the frequency of the vibrato rate clock 22 and Q is the modulo of the counter 27. Clearly the vibrato frequency $f_v$ can be adjusted by changing the frequency of the clock 22 using the rate control circuit 23. Note that during half of the vibrato period $T_P$ the fractional frequency number $R_v$ is added to the frequency number R, and during the other half period it is subtracted from R.

With the switch 19 in the position shown in FIG. 2, full depth vibrato will begin as soon as any instrument key 12 is depressed. To implement delayed vibrato, the switch 19 is set to its alternate position 19*a* so that the delay and scaling circuitry 35 is brought into operation. This circuitry 35 functions to delay the initiation of vibrato for a period of time $T_D$ after any key is depressed at the time $T_o$ (see FIG. 1). Vibrato begins at time $T_D$ with a depth that increases gradually in accordance with a scale factor s the magnitude of which is indicated by a broken line in FIG. 1. Maximum vibrato depth is reached at time $T_v$, and thereafter the vibrato continues at this depth until the key is released.

The vibrato delay is initiated when any instrument keyboard switch 12 is closed. Such closure provides a signal to an OR gate 36 which in turn triggers a "one-shot" monostable multivibrator 37.

The resultant output pulse on a line 38 is the "key depressed" signal which begins the vibrato delay period.

The scale factor s advantageously ranges in value from zero to one in certain fractional increments. In the circuit 35, the value s corresponds to the contents of a counter 39 which is reset to zero upon occurrence of the "key depressed" signal on the line 38. The contents of the counter 39 is supplied via a line 40 to a scaler 41. This scaler 41 multiplies the fractional frequency number $R_v$ present on the line 18 by the value s received on the line 40. The product $sR_v$ is supplied via the line 20 to the adder 21 where it is either added to or subtracted from the frequency number R depending on the sign bit on the line 31.

At the beginning of the vibrato delay period the contents of the counter 39 is zero. Hence the output of the scaler 41 likewise will be zero. Accordingly, the unmodified frequency number R will be provided on the line 16 and no vibrato will be introduced. The "key depressed" signal also resets a flip-flop 42 to the "0" state so that a low signal is present on a line 43, disabling an AND gate 44. So long as the AND gate 44 is disabled, the counter 39 remains at zero and no vibrato is introduced. As will be seen, the AND gate 44 remains thus disabled through the entire vibrato delay period.

The vibrato delay period is measured by a counter 45 which also is reset to zero upon occurrence of the "key depressed" signal. However, as soon as this "key depressed" pulse occurs, a flip-flop 46 is set to the "1" state, thereby enabling an AND gate 47 to provide pulses supplied from a vibrato delay clock 48 via a line 49 to the counter 45. Thus the counter 45 will be incremented at a rate established by the clock 48.

The desired vibrato delay time $T_D$ is set by a circuit 51 which supplies the value $T_D$ via a line 52 to a comparator 53. The other input to the comparator 53 is the contents of the counter 45. When these contents equal the value $T_D$ present on the line 52, a "compare" signal is provided on a line 54. Of course, this occurs at the end of the vibrato decay period. The compare signal on the line 54 resets the flip-flop 46, thereby disabling the AND gate 47 so that the counter 45 is no longer incremented.

More importantly, the compare signal on the line 54 sets the flip-flop 42 to the "1" state so that the AND gate 44 now is enabled. As a result, pulses from the clock 48 are supplied via the line 49 and the AND gate 44 to the counter 39. Accordingly, this counter 39 is incremented, gradually increasing the value of the scale factor s. The fractional frequency number $R_v$ on the line 18 is multiplied by the non-zero value s present on the line 40 and the quotient $sR_v$ either added to or subtracted from the frequency number R. As the contents of the counter 39 increases, the depth of vibrato increases as indicated by the broken line in FIG. 1.

Eventually the contents of the counter 39 reaches one. When this occurs, a comparator 55 provides an output signal via a line 56 and an OR gate 57 to reset the flip-flop 42. This disables the AND gate 44 so that the counter 39 remains set to $s=1$. Thereafter, vibrato production continues at the maximum depth.

In the circuit 35 the same vibrato delay clock 49 is used to advance the counters 39 and 45. However, this is not necessary. Separate clocks could be used to drive each of these counters.

Figure 3:
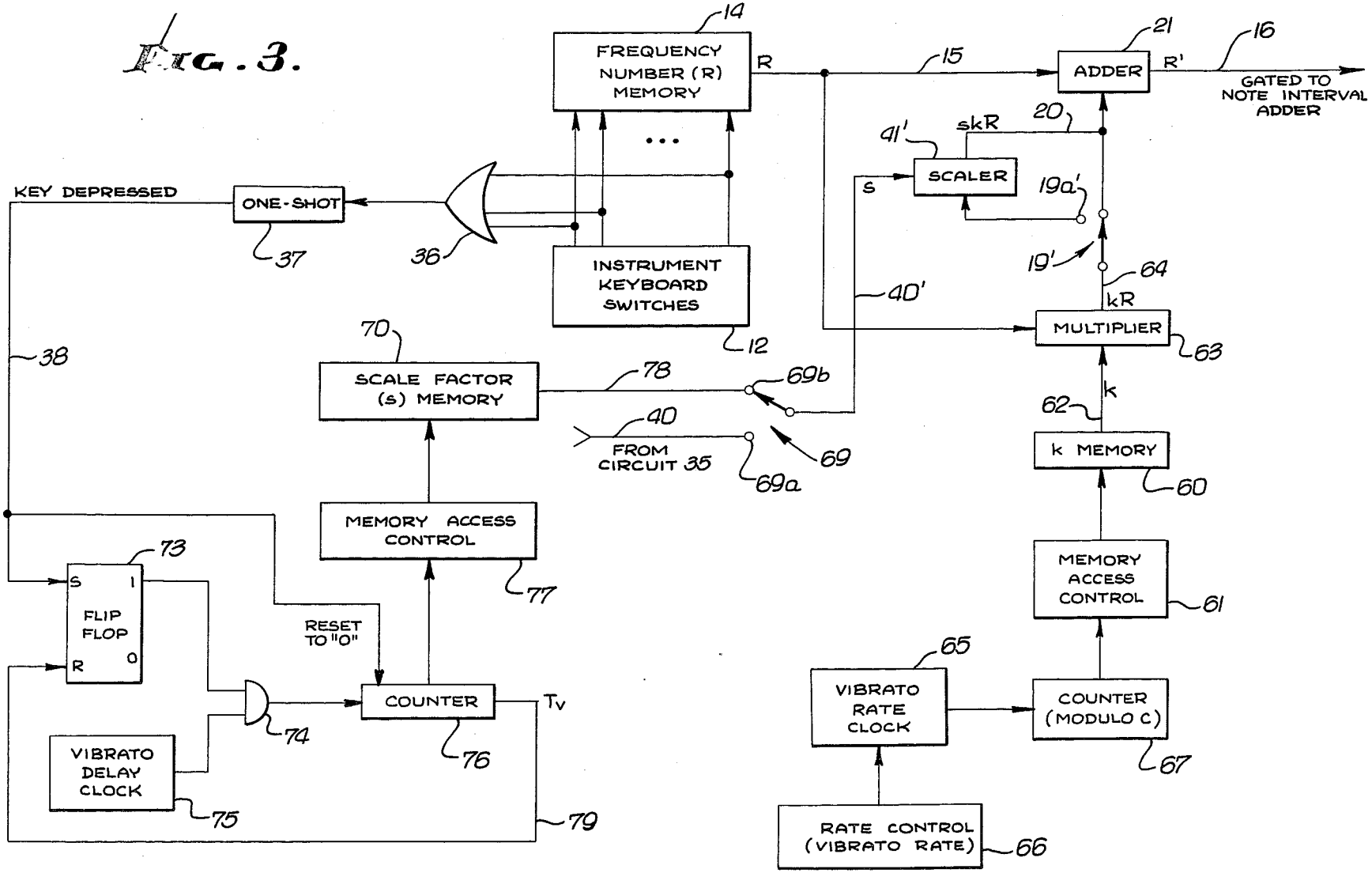
FIG. 3 is an electrical block diagram of alternative circuitry for implementing delayed vibrato and utilizing a memory to store values of $k$.

The alternative embodiment of FIG. 3 implements equation 2 above. To this end, a set of values *k* are stored in a memory 60. These values *k* are accessed programmatically by a memory access control 61 and supplied via a line 62 to a multiplier 63. There the frequency number R from the line 15 is multiplied by the value k present on the line 62 and the product $R_v=kR$ supplied via a line 64 and a switch 19' to the adder 21. The product $R'=R\pm kR$ then is supplied via the line 16 to the associated computor organ.

Advantageously the value *k* supplied from the memory 60 includes a sign bit. Moreover, the set of values *k* stored in the memory 60 is selected to produce the desired vibrato waveshape. This waveshape may be sinusoidal, but is by no means so limited. It can be of any shape, including a square wave, triangular, sawtooth or trapezoidal. By way of example, the following Table 1 sets forth values of *k* which may be stored in the memory 60 to produce a sinusoidal vibrato waveshape.

TABLE I

| Memory 60 Storage Location | k | Cents From True Frequency | Memory 60 Storage Location | k | Cents From True Frequency |
|---|---|---|---|---|---|
| 1 | +1.0000 | 0 | 17 | −1.0000 | 0 |
| 2 | +1.0028 | +4.9 | 18 | −1.0028 | −4.9 |
| 3 | +1.0055 | +9.6 | 19 | −1.0055 | −9.6 |
| 4 | +1.0081 | +13.9 | 20 | −1.0081 | −13.9 |
| 5 | +1.0102 | +17.7 | 21 | −1.0102 | −17.7 |
| 6 | +1.0121 | +20.8 | 22 | −1.0121 | −20.8 |
| 7 | +1.0134 | +23.1 | 23 | −1.0134 | −23.1 |
| 8 | +1.0143 | +24.5 | 24 | −1.0143 | −24.5 |
| 9 | +1.0145 | +25.0 | 25 | −1.0145 | −25.0 |
| 10 | +1.0143 | +24.5 | 26 | −1.0143 | −24.5 |
| 11 | +1.0134 | +23.1 | 27 | −1.0134 | −23.1 |
| 12 | +1.0121 | +20.8 | 28 | −1.0121 | −20.8 |
| 13 | +1.0102 | +17.7 | 29 | −1.0102 | −17.7 |

TABLE I-continued

| Memory 60 Storage Location | k | Cents From True Frequency | Memory 60 Storage Location | k | Cents From True Frequency |
|---|---|---|---|---|---|
| 14 | +1.0081 | +13.9 | 30 | −1.0081 | −13.9 |
| 15 | +1.0055 | +9.6 | 31 | −1.0055 | −9.6 |
| 16 | +1.0028 | +4.9 | 32 | −1.0028 | −4.9 |

The rate at which the values *k* are accessed from the memory 60 will determine the vibrato period $T_P$. This rate is established by a vibrato rate clock 65 having a frequency adjustable by means of a rate control 66. Output pulses from the clock 65 are supplied to a counter 67 of modulo C where C equals the number of values *k* in the set of such values stored in the memory 60. in the example of Table I above, C=32. With this arrangement, the contents of the counter 67 correspond to the address of the value *k* currently being accessed from the memory 60. In other words, if the counter 67 contents is "5," the memory access control 61 will access from the memory 60 the value *k* stored in the position 5. From Table I above, this value will be k=+1.0102. When the next pulse from the clock 65 occurs, the counter 67 will be incremented to "6" and the corresponding value k=+1.0121 will be supplied on the line 62.

Since the counter 67 resets to zero each time the value C is reached, it is apparent that the set of values *k* in the memory 60 will be repetitively accessed at a rate established by the clock 65. In other words, the vibrato wave shape established by the values *k* will be repeated during each vibrato period $T_P$. Obviously the shape of the vibrato can be varied merely by changing the values of k stored in the memory 60. The memory 60 and its associated memory access control 61 may be implemented using a conventional integrated circuit read only memory such as the Signetics type SIG 8223.

To implement delayed vibrato the switch 19' is set to the position **19*a*'. In this situation, the value kR on the line 64 is multiplied by the scale factor s present on a line 40' by a scaler 41'. The product skR is supplied via the line 20 to the adder 21.**

The scale factor s may be obtained from the circuit 35 of FIG. 2. In this case, a switch 69 would be set to the position **69*a* so that the value s from the counter 39 (FIG. 2) will be supplied via the line 40 and the switch 69 to the line 40'. Alternatively, with the switch 69 set to the position 69*b*, scale factors are obtained from a memory 70 (FIG. 3**) that contains a set of such scale factors.

To implement the initial vibrato delay, the "key depressed" signal on the line 38 sets a flip-flop 73 to the "1" state. This enables an AND gate 74 to provide pulses from a vibrato delay clock 75 to a counter 76 which itself is reset to zero upon occurrence of the "key depressed" signal.

The scale factor memory 70 is accessed by a memory access control 77 responsive to the contents of the counter 76. Preferably the control circuit 77 accesses no scale factor from the memory 70 during the time that the contents of the counter 76 are less than a value corresponding to the vibrato delay time $T_D$. Thus during the vibrato delay period, there will be no output from the memory 70. That is, a zero signal will be present on a line 78 effectively corresponding to the value *s*=O.

When the contents of the counter 76 have reached a count equal to the vibrato delay time $T_D$, the memory access control 77 will begin to access scale factors s from the memory 70 for supply via the line 78, the switch 69 and the line 40' to the scaler 41'. Consecutive values of s will be supplied each time the counter 76 is incremented. The scale factors s stored in the memory 70 may be linearly increasing in value, such as represented by the broken line in FIG. 1. However, this is not required and the scale factors s may have any values, so that the vibrato depth can be changed in any linear or non-linear fashion as a function of time.

Eventually the contents of the counter 76 will reach a value corresponding to $T_V$. The resultant output on a line 79 will reset the flip-flop 73 to the "O" state, thereby disabling the AND gate 74. No further pulses from the clock 75 will reach the counter 76, and the counter 76 contents will remain set at the value corresponding to $T_v$. Accordingly, the memory access control 77 will continue to access the corresponding scale factor s from the memory 70. Advantageously, this value is *s*=1 so that the vibrato will continue thereafter at the maximum vibrato depth.

To provide additional control by the musician of the maximum depth of vibrato, the scale factors supplied from the memory 70 all may be scaled by a selected amount. To this end, a scaler or shift register (not shown) may be placed in the line 78. By shifting all values of s one or two places to the right (i.e., dividing *s* by 2 or 4) the vibrato depth will be cut to one-half or one-fourth the established value.

Although in the foregoing description the inventive delayed vibrato circuitry has been described for use in conjunction with the patented computor organ, the invention is not so limited. The same implementation can be used with any electronic musical instrument in which the generated tone has a fundamental frequency proportional to a frequency number supplied to that instrument.

Intending to claim all novel, useful and unobvious features, shown or described, the applicant claims:

1. In an electronic musical instrument of the type wherein musical tones are generated in accordance with a frequency number R supplied thereto, the fundamental frequency of the generated tone being proportional to the value of said supplied frequency number, said musical instrument comprising a keyboard and circuitry connected to said keyboard for supplying to the tone generating components of said instrument the specific frequency number R corresponding to the nominal frequency of a note selected by depression of a keyboard key, the improvement for introducing delayed vibrato in the generated tone, comprising:

first means, connected to receive from said circuitry said specific frequency number R, for adding to said supplied specific frequency number R a periodically varying fractional frequency number $R_v$, said first means also being connected to the tone generating components of said instrument for supplying the sum to said tone generating components instead of said frequency number itself so that the generated tone exhibits vibrato, the maximum value of said fractional frequency number establishing the maximum depth of vibrato, the period of said fractional frequency number establishing the vibrato period, and second means, connected to said keyboard and to said first means, for delaying the production of vibrato for a preselected delay time beginning at the initiation of tone generation when said key is depressed.

2. An electronic musical instrument according to claim 1 wherein during the delay time said second means causes the value zero to be added by said first means instead of the periodically varying number $R_v$ so that the vibrato-free generated tone is at the nominal fundamental frequency established by the frequency number R.

3. An electronic musical instrument according to claim 1 further comprising;

a scaler for multiplying the fractional frequency number $R_v$ by a scale factor s, the product $sR_v$ being provided to said first means for addition to said frequency number R instead of the fractional frequency number $R_v$ itself.

4. An electronic musical instrument according to claim 3 further comprising;

timing means, connected to said second means and said scaler, for causing said scale factor s to be zero during said delay time beginning at the initiation of tone production, and for causing said scale factor to vary in value during a predetermined time period beginning at the end of said delay time, said scale factor being a constant after the end of said predetermined time period.

5. An electronic musical instrument according to claim 4 wherein said scale factor s increases monotonically from zero to unity during said predetermined time period and is unity thereafter.

6. An electronic musical instrument according to claim 4 wherein said timing means comprises;

a vibrato delay clock, a counter advanced by pulses from said clock beginning at the initiation of tone generation, and scale factor supply circuitry, responsive to the contents of said counter, for providing a zero scale factor to said scaler while the contents of said counter is less than a certain value corresponding to the end of said delay time, and for providing time varying scale factors to said scaler beginning when the contents of said counter reaches said certain value.

7. An electronic musical instrument according to claim 6 wherein said scale factor supply circuitry comprises;

a memory storing a set of scale factors, and a memory access control, responsive to the contents of said counter, for accessing from said memory scale factors of said set, each accessed scale factor being provided to said scaler.

8. An electronic musical instrument according to claim 1 wherein said fractional frequency number $R_v = kR$ where $k$ is a time varying value, together with;

a memory storing a set of values of $k$, said set of values establishing the vibrato waveform, vibrato rate timing circuitry, a memory access control for successively accessing said set from said memory at a rate established by said timing circuitry, said access rate thereby establishing the vibrato rate, and a multiplier for multiplying said frequency number R by the value $k$ accessed from said memory, the product $kR = R_v$ being added to said frequency number R by said first means.

9. An electronic musical instrument according to claim 1 wherein said fractional frequency number $$R_v = \frac{R}{2^n}$$

where $n$ is an integer, and further comprising;

a shift register receiving the frequency number R in binary form, and timing circuitry for causing said shift register to shift at a preselected rate, the direction of said shifting being reversed periodically, the shifted output of said register representing the fractional frequency number $$R_v = \frac{R}{2^n}$$

where $n$ is the number of positions that R has been shifted in said register, said output value $R_v$ being provided to said first means, the rate of said shifting establishing the vibrato rate.

* * * * *